US005239724A

United States Patent [19]

Salecker et al.

[11] Patent Number: 5,239,724

[45] Date of Patent: Aug. 31, 1993

[54] MECHANISM FOR ADVANCING A ROTATING CYLINDRICAL MEMBER

[75] Inventors: Roy Salecker; Rockwell T. Sloter, both of Mendota, Ill.

[73] Assignee: Spartan Tool, Mendota, Ill.

[21] Appl. No.: 828,040

[22] Filed: Jan. 30, 1992

[51] Int. Cl.[5] ..... B08B 9/02

[52] U.S. Cl. ..... 15/104.33

[58] Field of Search ..... 15/104.33; 74/25; 82/132

[56] References Cited

U.S. PATENT DOCUMENTS

| | | | |
|---|---|---|---|
| 3,394,599 | 7/1968 | Tucker | 74/25 |
| 3,451,089 | 6/1969 | Carlson et al. | 15/104.33 |
| 4,686,732 | 8/1987 | Irwin | 15/104.33 |
| 5,031,276 | 7/1991 | Babb et al. | 15/104.33 |

*Primary Examiner*—Edward L. Roberts

*Attorney, Agent, or Firm*—Wood, Phillips, Van Santen, Hoffman & Ertel

[57] ABSTRACT

A mechanism for advancing a rotating cylindrical member which has a frame and opening to accept a cylindrical member extending therethrough in a first line, and an advancing roller for engagement with a cylindrical member extending through the frame opening. The advancing roller is mounted to the frame for rotation about a first axis that is transverse to the first line to thereby cause a rotating cylindrical member in the frame opening that encounters the advancing roller to be advanced along the first line substantially parallel to the frame opening axis. The advancing roller is preferably carried by a mounting block which is mounted to the frame movably between first and second positions. By moving the mounting block between its first and second position, the advancing roller is moved towards and away from the frame opening axis to thereby vary the distance of the advancing roller from the frame opening axis to accommodate different diameters of cylindrical members to be advanced by the mechanism. Structure is provided to prevent movement of the advancing roller away from the frame opening axis in first and second different positions for the advancing roller relative to the frame opening axis and to allow selection of the first and second advancing roller positions without disassembling any part from the advancing mechanism.

20 Claims, 3 Drawing Sheets

FIG. 4
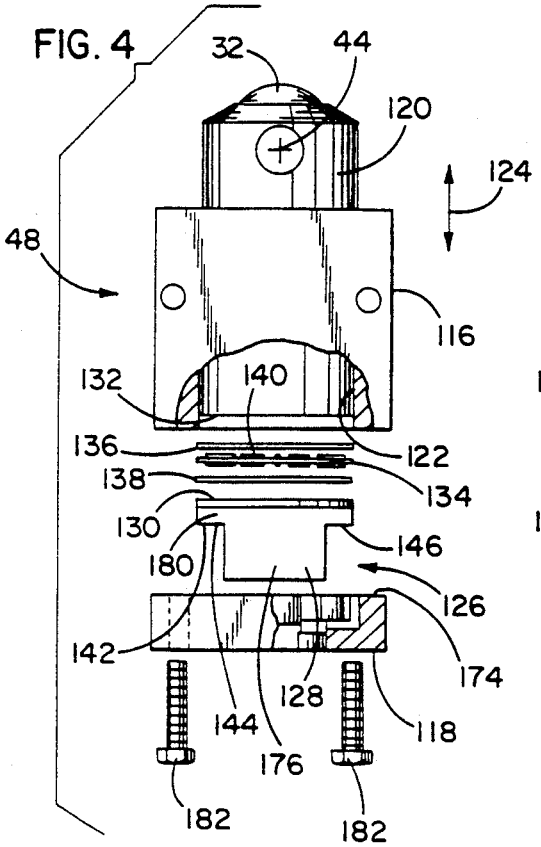
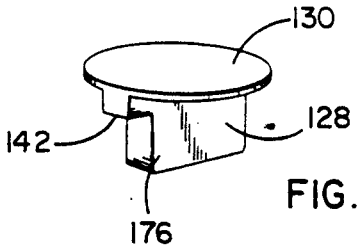
FIG. 5
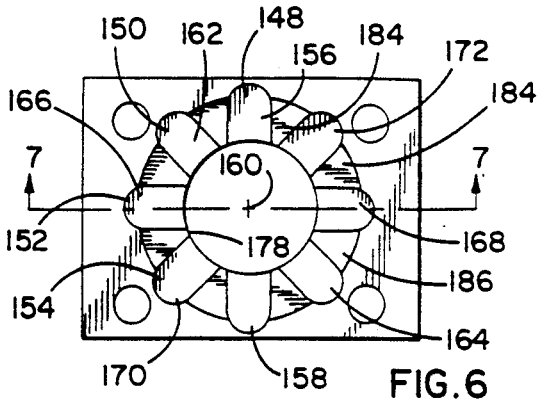
FIG. 6
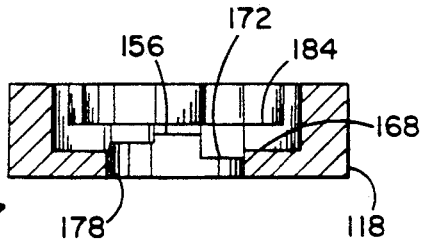
FIG. 7
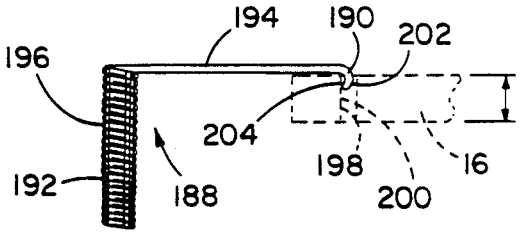
FIG. 10
FIG. 8
(PRIOR ART)
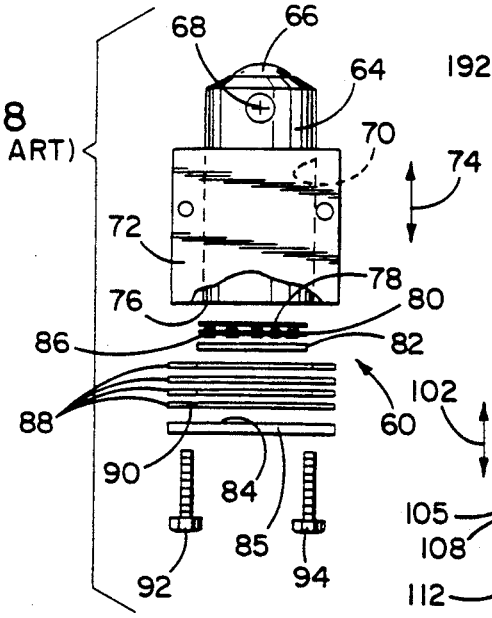
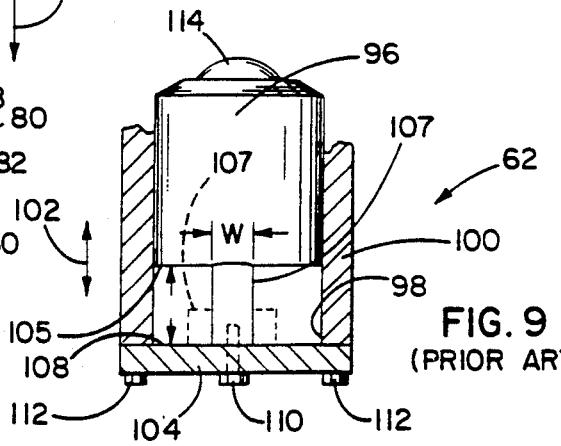
FIG. 9
(PRIOR ART)

MECHANISM FOR ADVANCING A ROTATING CYLINDRICAL MEMBER

BACKGROUND OF THE INVENTION

1. Field of the Invention

This invention relates to mechanisms for controllably advancing a rotating cylindrical member and, more particularly, to a mechanism that can be adjusted to accommodate different diameters of rotating cylindrical members.

2. Background Art

It is known to advance rotating cylindrical members, such as sewer cables, through the use of rollers which engage the cable. The rollers are mounted on a frame which has an opening with an axis that aligns with the axis of the cylindrical member to be advanced. The rollers project into the frame opening and define the effective diameter for the frame opening. Normally, the rotational axes of the advancing rollers are simultaneously variable to control the speed, and in some cases the direction, of advancement of the cable. Exemplary advancing mechanisms are shown in U.S. Pat. Nos. 3,394,599 (Tucker) and 3,451,090 (Lo Presti et al).

One drawback with some conventional mechanisms for advancing a rotating cylindrical member is that the mechanism is suitable for only a single diameter of cylindrical member. To obviate this problem, structures have been developed to permit a single mechanism to accommodate more than one diameter of cylindrical member. One such structure employs a plurality of shims captively held between a frame cap and a frame body on the mechanism. The cap abuts a mounting block which carries the advancing roller. The mounting block is mounted to the frame so that it and the advancing roller thereon are movable towards and away from the axis of the opening in the frame through which the cylindrical member extends. By adding shims, the distance of the cap from the frame opening axis is increased, which allows the mounting block, with the roller thereon, to move further away from the frame opening axis than it can in the absence of the shims. By so doing, the diameter of the cylindrical member that the mechanism will accommodate is increased. Similarly, by removing the shims, the cap is moved inwardly towards the frame opening axis so that the maximum diameter of cylindrical member that the mechanism will accommodate is reduced. In a typical mechanism, three mounting blocks with advancing rollers are provided on the frame and equidistantly spaced around the periphery of the frame opening. Each cap may be held in place by four bolts. Since all caps must be simultaneously adjusted to change the cable capacity for the advancing mechanism, the user must remove twelve bolts, remove or add shims, and replace the bolts. This is not only an inconvenient operation, but it is also very time consuming. If for any reason the wrong number of shims are added or removed, the entire procedure must be repeated.

Another prior art structure that is used to vary the cable capacity for the advancing mechanism also employs a removable frame cap. The cap is bolted to the frame body so as to be removable therefrom. A rectangular blocking wall is in turn removably bolted to the cap. The blocking wall is selectively bolted in one of two different positions. In one position, the longer cross-sectional dimension acts between the cap and the advancing roller mounting block. In the other position, the shorter cross-sectional dimension acts between the mounting block and the cap. In the former position, the mounting block and advancing roller are urged closer to the frame opening axis than in the latter position. There are several drawbacks with this structure. First of all, not only must the cap be removed, as required with the previously described structure, but the blocking wall must be additionally unbolted from, repositioned and reattached to the cap. This is also a time consuming and inconvenient operation. Additionally, the surface that abuts the mounting block may over time become worn. The result of this is that the mounting block may not be stably and consistently maintained in the positions required to accommodate different diameters of cylindrical members.

Tucker (U.S. Pat. No. 3,394,599) discloses advancing roller mounting blocks that are spring biased inwardly towards the frame opening axis. While the tension on a cylindrical member within the frame opening may be altered with Tucker's disclosed structure, the mounting blocks and advancing rollers thereon are only positively prevented from moving outwardly from only one position; that being when the roller supporting yoke encounters the rigid frame body.

Another problem with prior art mechanisms is that it is difficult to initially direct the cylindrical member into the frame opening, as from one side of the frame on which a cable holding drum is provided to the other side of the frame to which the cable is to be advanced. Typically, sewer cables have a free end with a bore extending therethrough angularly oriented with respect to the length of the cable. It is common in the prior art for the user to direct a screwdriver or other pointed object into that bore and then to push the cable into the frame opening from the drum side of the frame. The user can assist this operation by threading the cable through by hand from the drum side of the frame. Depending upon the configuration of the device and the proximity of the drum to the advancing mechanism, threading of the cable may be a very awkward procedure.

SUMMARY OF THE INVENTION

The present invention is specifically directed to overcoming the above-enumerated problems in a novel and simple manner.

More particularly, the invention is a mechanism for advancing a rotating cylindrical member which has a frame and opening to accept a cylindrical member extending therethrough in a first line, and an advancing roller for engagement with a cylindrical member extending through the frame opening The advancing roller is mounted to the frame for rotation about a first axis that is transverse to the first line to thereby cause a rotating cylindrical member in the frame opening that encounters the advancing roller to be advanced along the first line substantially parallel to the frame opening axis. The advancing roller is preferably carried by a mounting block which is mounted to the frame movably between first and second positions. By moving the mounting block between its first and second position, the advancing roller is moved towards and away from the frame opening axis to thereby vary the distance of the advancing roller from the frame opening axis to accommodate different diameters of cylindrical members to be advanced by the mechanism. Structure is provided, to prevent movement of the advancing roller away from the frame opening axis in first and second different positions for the advancing roller relative to the frame opening axis. The preventing structure includes a selector mechanism with a wall that is movable between first and second positions. In the first wall position, the wall prevents movement of the advancing roller in its first position away from the frame opening axis. In the second wall position, the wall prevents movement of the advancing roller in its second position away from the frame opening axis. There is cooperating structure on the selector mechanism and frame for allowing the wall to be moved between the first and second positions therefor without disassembling any part from the advancing mechanism and for releasably holding the wall consistently in each of its first and second positions.

Because no disassembly is required to alter the effective frame opening diameter, this diameter adjustment can be quickly and conveniently accomplished.

In one form, the selector mechanism includes a dial defining the wall. The dial is movable between first and second positions corresponding to the first and second wall positions, respectively. In one form, the dial is conveniently rotatable between its first and second positions and the cooperating structure for releasably holding the wall includes structure for releasing the dial from its first and second positions only upon axially moving the dial relative to the frame before rotation of the dial is effected.

To prevent the movement of the advancing roller away from first and second positions, a first shoulder, facing in a first direction, is provided on one of the frame and preventing structure. Second and third shoulders are provided on the other of the frame and preventing structure and face oppositely to the first direction. The first shoulder is abuttable selectively to the second and third shoulders to place the wall respectively in its first and second positions.

In one form, the first shoulder is on the dial. With a rotatable dial, in one form the first shoulder has portions at diametrically opposite positions relative to the dial axis. Similarly, the second and third shoulders each include portions at diametrically opposite positions relative to the dial axis.

In one form, the dial has a one-piece construction that defines the wall and the first shoulder.

In one form of the invention, the frame includes a cap and a main body and the cap, main body and dial cooperate to captively maintain the dial in an operative position with the cap attached to the main body.

In one form of the invention, there are a plurality of advancing rollers, advancing roller mounting blocks and preventing structures which are structurally the same, and cooperate with the frame in the same manner, as the advancing roller, advancing roller mounting block and preventing structure, described above.

The invention also contemplates an improvement in a mechanism for advancing a rotating cylindrical member of the type having a frame with an opening therethrough to accept a cylindrical member advanceable therethrough in a first line, an advancing roller for engagement with a rotating cylindrical member extending through the frame opening to thereby cause advancement of the rotating cylindrical member in the first line, an advancing roller mounting block carrying the advancing roller, and cooperating structure on the advancing roller mounting block and frame for allowing the mounting block to be moved between first and second positions corresponding to first and second advancing roller positions. The advancing roller in its first position is closer to the frame opening axis than it is in its second position, to thereby accommodate different diameters of rotating cylindrical members extending through the frame opening. The improvement is structure for selectively preventing movement of the advancing roller away from the opening axis with the advancing roller in each of its first and second positions. The preventing structure includes a dial that is movable between first and second positions corresponding to the first and second positions of the advancing roller. Structure is provided for connecting the dial to the frame in an operative position and for releasably holding the dial consistently in each of its first and second positions. The dial is movable between its first and second position without disassembly of any of part of the advancing mechanism and preventing structure.

In one form, the frame has a body and a cap, with the cap being connectable to the frame body so that the frame body cap and dial cooperate to maintain the dial in its operative position with the cap on the frame.

In one form, the dial has a tab extending to externally of the frame cap to be engaged by a user.

Another aspect of the invention is the combination of a mechanism for advancing a rotating cylindrical member and a tool for drawing a rotating cylindrical member into an operative position on the advancing mechanism. The advancing mechanism has a frame with spaced sides and an opening to accept a cylindrical member extending therethrough in a first line. Structure is provided on the frame for advancing a rotating cylindrical member along the first line. The tool has a grip to be held by the hand of a user, an engaging end remote from the grip to be operatively engaged with the free end of a rotating cylindrical member to be advanced by the advancing mechanism, and an arm interconnecting the grip and engaging end. The engaging end is extendable from one of the spaced frame sides through the frame opening to the other of the spaced frame sides by the hand of a user holding the grip on the one side of the frame.

With the inventive structure, a user can grip the tool on the one side of the frame and draw a free end of a cylindrical member operatively engaged by the engaging end of the tool on the other side of the frame through the frame opening sufficiently to be engaged by the advancing structure.

The invention also contemplates the above structure in combination with a rotatable cylindrical member with there being cooperating structure on the cylindrical member and engaging end of the tool to allow the cylindrical member to be drawn by the tool through the frame opening.

The cooperating structure, in one form, is a shoulder on the cylindrical member facing in a first direction and a shoulder on the tool engaging and facing oppositely to the first direction. The shoulders on the tool and cylindrical member abut with the engaging tool operatively engaged with the free end of the cylindrical member.

In one form, the tool arm is elongate and has an offset end defining the shoulder on the engaging end of the tool. The cylindrical member has a bore therethrough, with the bore defining the shoulder on the cylindrical member.

In one form, the engaging end and arm are formed by a single piece of wire. The grip may also be formed by the single piece of wire. The arm is substantially straight with the offset end bent out of the line of the arm. In a preferred form, the offset end makes a substantially right angle with the line of the arm.

In one form, the tool grip is cylindrical and has an axis that is substantially perpendicular to the line of the arm. For convenience of handling, the grip has a knurled outer surface to be engaged by the hand of a user.

In a preferred form, the frame opening has a diameter and the length of the offset end is less than the diameter of the frame opening so as to allow the free passage of the engaging end with the cylindrical member thereon through the frame opening.

BRIEF DESCRIPTION OF THE DRAWINGS

FIG. 4 is an enlarged, exploded, elevation view of an advancing roller subassembly, according to the present invention, for varying the spacing of the advancing roller relative to the axis of the advancing cylindrical member;

FIG. 5 is a perspective view of a selector dial on the subassembly of FIG. 4;

FIG. 6 is an end view of a frame cap which cooperates with the selector dial of FIG. 5 to selectively maintain the advancing roller on the subassembly of FIG. 4 in predetermined positions;

FIG. 7 is a cross-sectional view of the cap taken along line 7—7 of FIG. 6;

FIG. 8 is an exploded view of a prior art subassembly for varying the position of an advancing roller thereon;

FIG. 9 is a cross-sectional view of a further prior art subassembly for varying the position of an advancing roller;

FIG. 10 is a side elevation view of a tool for drawing the end of a cylindrical member from one side of the inventive advancing mechanism through an opening therein to the other side of the advancing mechanism to thereby operatively position the rotating cylindrical member.

DETAILED DESCRIPTION OF THE DRAWINGS

Figure 1:
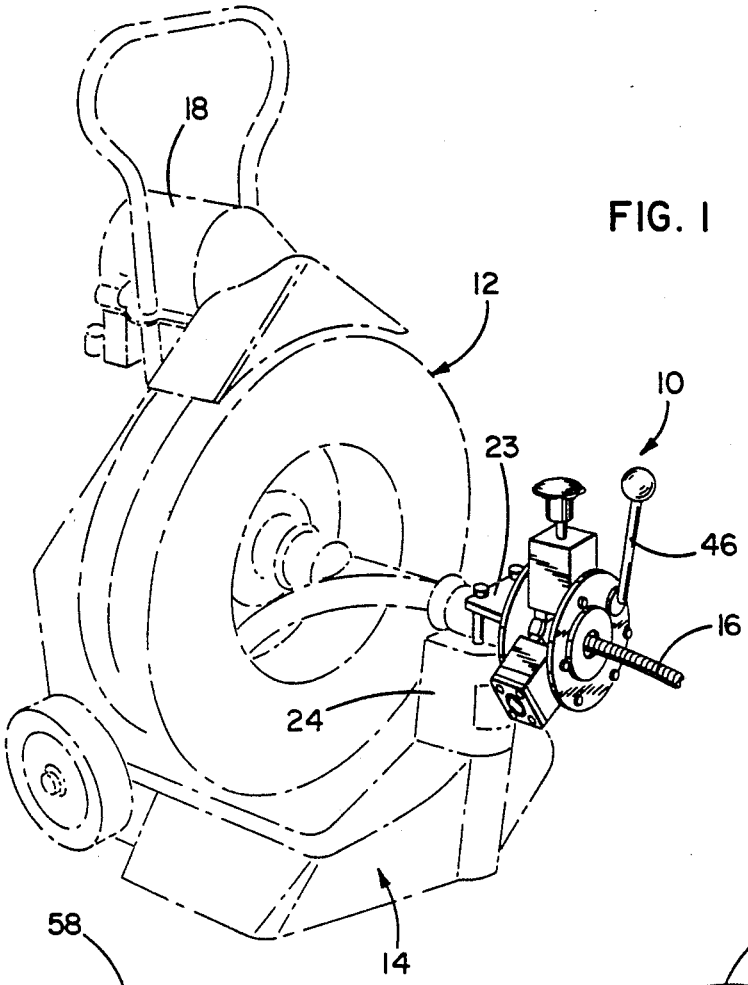
FIG. 1 is a perspective view of a mechanism for advancing a rotating cylindrical member, according to the present invention, operatively connected to a sewer cable supporting drum.

In FIG. 1, a mechanism for advancing a rotating cylindrical member, according to the present invention, is shown at 10 operatively associated with a cable drum 12 operatively positioned on a wheeled cart 14 which facilitates transportation of the drum 12. The drum 12 carries a supply of conventional sewer cable 16 and is mounted for rotation by a motor 18 relative to the mobile cart 14.

Figure 2:
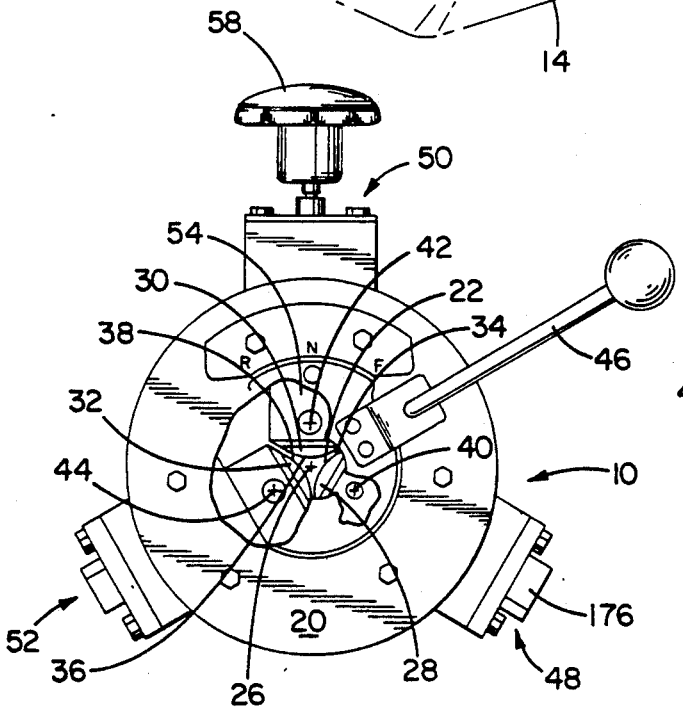
FIG. 2 is an enlarged, front elevation view of the inventive advancing mechanism.
Figure 3:
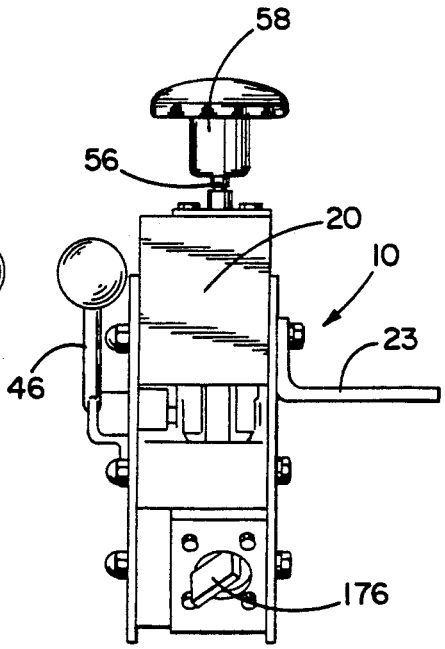
FIG. 3 is an enlarged, side elevation view of the inventive advancing mechanism.

As seen in FIGS. 2 and 3, the mechanism 10 has a frame 20 defining an opening 22 which the cable 16 is directed for advancement thereof in a line substantially parallel to the length of the cable 16. The mechanism 10 has a rigid bracket 23 that is fixedly mounted upon an upright support 24 on the cart 14 so that the rotational axis of the drum 12 coincides with the central axis 26 of the frame opening 22. Advancing rollers 28, 30, 32 project into the frame opening 22 and have peripheral surfaces 34, 36, 38 which cooperatively define an effective diameter for receipt of the cable 16.

The rollers 28, 30, 32 rotate relative to the frame 20 about spaced axes 40, 42, 44, consecutively. With the axes 40, 42, 44 parallel to the axis 26 of the frame opening 22, the device is in the "neutral" position. That is, the cable 16 being rotated by the drum 12 effects rotation of the rollers 28, 30, 32 without the cable 16 being withdrawn into the drum 12 or being advanced therefrom. Through a control arm 46, the axes 40, 42, 44 for the rollers 28, 30, 32 are reoriented. With the control arm 46 moved to a forward advance position, shown in FIG. 2, the roller axes 40, 42, 44 are uniformly angled relative to the frame opening axis 26 to thereby define a helical engagement path which results in the advancement of the cable 16 forwardly out of the drum 12. Pivoting of the control arm 46 through approximately 90°, in a counterclockwise direction in FIG. 2, places the advancing mechanism 10 in a reverse mode position. In this mode, the axes 40, 42, 44 are simultaneously repositioned through approximately 90° from the position they occupy with the arm 46 in the forward position. This results in the advancement of the cable 16 in a reverse direction, i.e. back into the drum 12.

It is not necessary to understand the details of the control mechanism for the rollers 28, 30, 32, to effect angular reorientation thereof, to fully comprehend the present invention. A suitable mechanism through which this angular reorientation of the rollers 28, 30, 32 can be accomplished is shown in U.S. Pat. No. 3,394,599, with another relevant structure shown in U.S. Pat. No. 3,451,090. The disclosures in both of these patents are incorporated herein by reference.

The present invention rather is directed to structure for controllably moving the rollers 28, 30, 32 towards and away from the frame opening axis 26 to thereby alter the effective diameter of the opening 22 to accommodate different diameters of cylindrical members to be advanced by the mechanism 10. In the mechanism 10 shown, there are three frame subassemblies 48, 50, 52 for varying the position of the advancing rollers 28, 30, 32 relative to the frame opening axis 26. Two of such subassemblies 48, 52, are made according to the present invention. The other subassembly 50 operates differently.

More specifically, the subassembly 50 consists of a mounting block 54 for the advancing roller 30. The frame 20 has a cylindrical bore (not shown) for reception of the generally cylindrical mounting block 54 which is movable guidingly in FIG. 2 vertically upwardly and downwardly to thereby carry the roller 30 towards and away from the opening axis 36. A control rod 56 is threaded into the frame 20 and is, by rotation, extendable towards and retractable from the opening axis 26. The free end (not shown) of the control rod 56 engages the mounting block 54. Rotation of the control rod 56, in one direction through an enlarged control handle 58 in FIG. 2, results in the free end of the rod 56 driving the mounting block 54 towards the axis 26. Rotation of the control rod 56 opposite to the one direction allows the mounting block 54 to be moved upwardly further away from the axis 26 than is possible with the structure as shown in FIGS. 2 and 3.

Two prior art subassemblies for controlling the position of advancing rollers are shown at 60 and 62 in FIGS. 8 and 9 respectively. The subassembly 60 has a mounting block 64 for an advancing roller 66 that is rotatable about an axis 68. The mounting block 64 is guided in a bore 70 defined by a frame 72 for movement in FIG. 8 vertically upwardly and downward as indicated by double-headed arrow 74. The bottom surface 76 of the mounting block 64 bears upon a washer 78, bearing element 80, and a washer 82, which is in turn borne against a blocking surface 84 on a frame cap 85. The bearing element 80 has a plurality of rollers 86 to permit the mounting block 64 to be readily rotated about its length to alter the angle of the advancing roller axis 68 relative to the frame 72.

A plurality of shims 88 are stacked between the mounting block surface 76 and the cap surface 84. The shims 88 have openings 80 therethrough to allow the washers 78, 82, bearing element 80 and mounting block 64 to pass therethrough and engage the cap surface 84.

It can be seen that the number and thickness of the shims 88 determine the spacing between the cap surface 84 and the frame 72. The greater the number of shims 88, or the thickness thereof, the greater is the distance that the mounting block 64 and advancing roller 66 can move downwardly away from the axis 26 of the frame opening 22 through which the cable 16 extends.

The cap 85 is held positively in place preferably by four bolts 92, 94 (two shown). If one desires to increase the diameter of the frame opening 22, one would remove the bolts 92, 94, separate the cap 85 from the subassembly 60, and add additional shims 88. The cap 85 is then reassembled and the bolts 92, 94 tightened to complete the subassembly. To reduce the diameter of the frame opening, the same procedure is followed, however, one or more shims 88 are removed.

It can be seen that even if a minor adjustment is needed, substantial disassembly and manipulation of parts is required, after which reassembly must take place. This is time consuming and inconvenient, particularly when this effort is multiplied by the number of subassemblies 60 that are in the particular mechanism.

In the subassembly 62, a mounting block 96 is mounted within the bore 98 of a frame 100 for guided movement in the line of double-headed arrow 102. A cap 104 is mounted to the frame 100 to intercept the bottom 105 of the mounting b 96 to limit downward movement of the mounting block 96.

A blocking wall is connected to the surface 108 of the cap 104 as by bolts 110. The blocking wall 107 has a rectangular cross section with a longer cross-sectional dimension L and a shorter cross-section dimension W.

With the blocking wall 107 situated in the solid line position of FIG. 1, the blocking wall 107 maintains a spacing L between the bottom 105 of the mounting block 96 and the surface 108 of the cap 104.

By removing the bolts 110, the blocking wall 106 can be repositioned to the phantom line position of FIG. 9 so that the blocking wall 107, acting between the mounting block 96 and cap 104, maintains a space W therebetween. The same bolts 110 can be used to secure the blocking wall in the phantom line of FIG. 9.

Access to the blocking wall 107 is gained by releasing bolts 112, to thereby allow separation of the cap 104 from the frame 100. This arrangement thus may require the removal and replacement of at least six and possibly eight bolts 110, 112 for each subassembly 62 to reposition the blocking wall 107 to set the desired position of the advancing roller 114 on the mounting block 106.

The inventive structure overcomes the problems discussed with respect to the subassemblies 60,62 shown in FIGS. 8 and 9, respectively. The subassemblies 48, 52, according to the invention, and shown in FIG. 2, are substantially the same and thus detailed description will be limited to exemplary subassembly 48, the details of which are shown in FIGS. 4–7.

The subassembly 48 has two frame parts—a main frame body 116 and a frame cap 118. A mounting block 120 is guided within a bore 122 within the frame body 116 in the line of double-headed arrow 124. The mounting block 120 supports the advancing roller 32 for rotation about the axis 44.

A selector mechanism at 126′ is used to prevent the mounting block 120, and the advancing roller 32 thereon, from moving downwardly in FIG. 4 relative to the frame body 116 from, in the depicted embodiment, three different positions. The exact number of positions is a matter of design choice.

The selector mechanism has a dial 128 with a planar blocking wall 130 having a diameter substantially equal to that of the bore 122. The wall 130 acts against the wall 132 of the mounting block 120 through a bearing 134 sandwiched between two washers 136, 138. The bearing 134 and washers 136, 138 are extendable into the bore 122. A plurality of rollers 140 on the bearing 134 facilitate rotation of the mounting block 120 about its lengthwise axis and thereby repositioning of the axis 44 of the advancing roller 32 relative to the frame opening 22.

The position of wall 130 along line 124, and thus the position of the advancing roller 32, is determined by cooperating structure on the dial 128 and frame cap 118. The dial 128 has a first shoulder 142 with diametrically opposite shoulder portions 144, 146 for simultaneously engaging one of four different recessed shoulders 148, 150, 152, 154 on the frame cap 118. The shoulder 148 has shoulder portions 156, 158 at diametrically opposite locations relative to the axis 160 of the mounting block 120 and dial 128 for simultaneous engagement with shoulder portions 144, 146 on the dial 128. Similarly, the shoulder 150 has shoulder portions 162, 164; the shoulder 152 has shoulder portions 166, 168; and the shoulder 154 has shoulder portions 170, 172.

The shoulders 148, 150, 152, 154 are all defined by undercutting the upper cap surface 174 in FIG. 4. The depth of the undercuts defining the shoulders 148, 150, 152, 154 increases progressively from one to the next so that the shoulder 142, which abuts the shoulders 148, 150, 152, 154, extends progressively deeper into the cap 118 as it abuts the shoulders 148, 150, 152, 154, consecutively.

To effect assembly of the dial 128, an integral finger tab 176 is initially dropped through a bore 178 in the cap 118 so as to project outwardly therefrom as seen in FIGS. 2 and 3 to allow convenient manipulation of the dial 128 from externally of the subassembly 48. As seen in FIG. 4, the dial 128 is generally T-shaped in cross section. The cross bar 180 of the "T", defining the shoulder 142, drops into and engages both shoulder portions 156, 158; 162, 164; 166, 168; 170, 172. The frame cap 118 is removably held in place by bolts 182. With this arrangement, the dial 128 is captively held between the frame cap 118 and frame body 116.

Between adjacent shoulders 148, 150, 152, 154 are dividing walls 184 which rise above all of the shoulders 148, 150, 152, 154. The top surface 186 of each of the dividing walls 184 is at approximately the same height in relationship to the cap surface 174 and slightly above the shallowest shoulder portions 156, 158. The dividing walls 184 define abutments which hold the dial in the pockets bounded by the shoulders 148, 150, 152, 154 and adjacent walls 184. Indicia (not shown) can be provided on the dial 128 and cap 118 to visually ascertain the position of the dial 128.

With the subassembly 48 assembled, the mounting block 120, under its own weight, urges the dial 128 through the bore 178 to thereby bring the shoulder 142 into abutting engagement with one of the oppositely facing shoulders 148, 150, 152, 154. With the shoulder 142 engaging the shoulder 148, the blocking wall 130 is in a first position in which the advancing roller 32 is closest to the axis 40. To progressively increase the effective diameter of the opening 22, the dial 128 can be lifted sufficiently that the shoulder 142 clears the top surface 186 of the dividing walls 184 and then turned to place the shoulder 142 in abutting relationship with the shoulders 150, 152 or 154, corresponding to second, third and fourth positions for the dial 128, the mounting block 120 and the advancing roller 32 on the mounting block 120. Lifting and turning of the dial 128 is facilitated by the projecting tab 176.

Once the subassembly 48 is assembled, the user need not disassemble any part of the subassembly 48 or frame to effect adjustment of the advancing roller 32. All that is required is a slight axial pressure upwardly on the tab 176 and a turn of the dial 128 about the axis 160 sufficiently to seat the shoulder 142 against the desired shoulder 148, 150, 152, 154 on the frame cap 118. The mounting block 120 and walls 184 maintain the dial 128 in each of its first, second, third and fourth positions.

Figure 11:
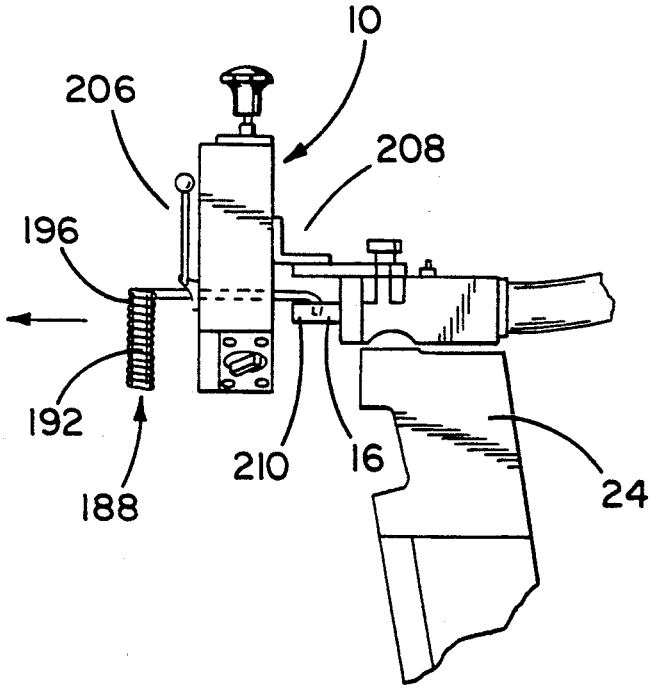
FIG. 11 is a fragmentary side elevation view of a portion of the inventive advancing mechanism with the tool positioned to begin drawing of the end of a cylindrical member through the advancing mechanism.

Another aspect of the invention is the provision of a tool 188, as shown in FIGS. 10 and 11. The tool has a cable engaging free end 190, a cylindrical grip portion 192 and an elongate arm/body 194 connecting between the grip 192 and the cable engaging end 190. In a preferred form, the tool 188 is made from one formed piece of wire with the grip 192 being defined by a number of turns which effectively produce a knurled outer surface 196 for comfortable handling by the user.

The cable 16 has a through bore 198 extending transverse to its length and defining a shoulder 200 facing in a trailing direction. The cable engaging end 190 of the tool 188 has an offset 202 bent at approximately 90° to the body length 194 and defining a shoulder 204 which, with the offset 202 penetrating the bore 198, engages the shoulder 200 so that the cable 16 can be drawn lengthwise by pulling on the grip 192.

The offset 202 has a length that is less than the diameter of the opening 22 to allow the cable engaging end to be drawn with the tool 188 from one side 206 of the frame 10 through the opening 22 to the other side 208 of the frame without interference and to allow the slight maneuvering necessary to situate the offset 202 on the tool end in the cable bore 198. By drawing on the grip 192, the cable 16 can be drawn forwardly from the drum 12 through the frame opening 22 for operative engagement by the rollers 28, 30, 32. This obviates the need to try to thread the free cable end 210 through the frame opening 22, as by hand or as by using a tool, from the other side 208 of the frame 10.

The foregoing disclosure of specific embodiments is intended to be illustrative of the broad concepts comprehended by the invention.

We claim:

1. A mechanism for advancing a rotating cylindrical member, said advancing mechanism comprising:

a frame having an opening to accept a cylindrical member extending therethrough in a first line, said opening having an axis;

an advancing roller for engagement with a cylindrical member extending through said frame opening;

means for mounting the advancing roller to the frame for rotation about a first axis that is transverse to the first line to thereby cause a rotating cylindrical member in said frame opening the encounters the advancing roller to be advanced along said first line substantially parallel to the frame opening axis, said roller mounting means including an advancing roller mounting block, there being cooperating means on the frame and advancing roller mounting block to move the advancing roller mounting block between first and second positions and as an incident thereof the advancing roller selectively towards and away from the frame opening axis to vary the distance of the advancing roller from the frame opening axis and thereby accommodate different diameters of a cylindrical member to be advanced by said mechanism; and means for selectively preventing movement of the advancing roller away from the frame opening axis in first and second different positions for the advancing roller relative to the frame opening axis, said preventing means including a selector mechanism including a wall that is movable between first and second positions, said selector wall in said first position therefor preventing movement of the advancing roller in said first position therefor away from the frame opening axis, said selector wall in said second position therefor preventing movement of the advancing roller in said second position therefor away from the frame opening axis, said selector mechanism comprising a dial that is non-threadably connected to the frame and movable by combined axial and rotational movement thereof relative to the frame about a first axis that is transverse to the frame opening axis between first and second positions, there being cooperating means on the dial and frame for allowing the wall to be moved between the first and second positions therefor as an incident of the dial being moved between its first and second positions without disassembling any part from the advancing mechanism and for releasably holding the wall consistently in each of its first and second positions.

2. The advancing mechanism for a cylindrical member according to claim 1 wherein the dial defines the wall that abuts the roller mounting block in its first and second positions to thereby prevent movement of the advancing roller away from the opening axis.

3. The advancing mechanism according to claim 2 wherein said frame includes a cap and a main body and there are cooperating means on the cap, main body and dial to captively maintain the dial in an operative position with the cap attached to the main body.

4. The advancing mechanism according to claim 1 wherein there are a plurality of advancing rollers, advancing roller mounting blocks and preventing means which are structurally the same, and cooperate with the frame in the same manner, as the first claimed advancing roller, advancing roller mounting block, and preventing means.

5. A mechanism for advancing a rotating cylindrical member, said advancing mechanism comprising:

a frame having an opening to accept a cylindrical member extending therethrough in a first line, said opening having an axis;

an advancing roller for engagement with a cylindrical member extending through said frame opening;

means for mounting the advancing roller to the frame for rotation about a first axis that is transverse to the first line to thereby cause a rotating cylindrical member in said frame opening that encounters the advancing roller to be advanced along said first line substantially parallel to the frame opening axis, said roller mounting means including an advancing roller mounting block, there being cooperating means on the frame and advancing roller mounting block to move the advancing roller mounting block between first and second positions and as an incident thereof the advancing roller selectively towards and away from the frame opening axis to vary the distance of the advancing roller from the frame opening axis and thereby accommodate different diameters of a cylindrical member to be advanced by said mechanism; and means for selectively preventing movement of the advancing roller away from the frame opening axis in first and second different positions for the advancing roller relative to the frame opening axis, said preventing means including a selector mechanism including a wall that is movable between first and second positions, said selector wall in said first position therefor preventing movement of the advancing roller in said first position therefor away from the frame opening axis, said selector wall in said second position therefor preventing movement of the advancing roller in said second position therefor away from the frame opening axis, there being cooperating means on the selector mechanism and frame for allowing the wall to be moved between the first and second positions therefor without disassembling any part from the advancing mechanism and for releasably holding the wall consistently in each of its first and second positions, wherein the selector mechanism comprises a dial that has the wall thereon that abuts the roller mounting block in its first and second positions to thereby prevent movement of the advancing roller away from the opening axis and the cooperating means on the selector mechanism and frame comprises cooperating means on the frame and dial for allowing the dial to be moved between first and second positions corresponding to the first and second wall positions, respectively, wherein the dial is rotatable between its first and second positions and the cooperating means on the selector mechanism and frame includes means for releasing the dial from one of its first and second positions to the other of its first and second positions only by effecting movement of the dial axially of the dial relative to the frame before effecting rotation thereof.

6. A mechanism for advancing a rotating cylindrical member, said advancing mechanism comprising:

a frame having an opening to accept a cylindrical member extending therethrough in a first line, said opening having an axis;

an advancing roller for engagement with a cylindrical member extending through said frame opening;

means for mounting the advancing roller to the frame for rotation about a first axis that is transverse to the first line to thereby cause a rotating cylindrical member in said frame opening that encounters the advancing roller to be advanced along said first line substantially parallel to the frame opening axis, said roller mounting means including an advancing roller mounting block, there being cooperating means on the frame and advancing roller mounting block to move the advancing roller mounting block between first and second positions and as an incident thereof the advancing roller selectively towards and away from the frame opening axis to vary the distance of the advancing roller from the frame opening axis and thereby accommodate different diameters of a cylindrical member to be advanced by said mechanism; and means for selectively preventing movement of the advancing roller away from the frame opening axis in first and second different positions for the advancing roller relative to the frame opening axis, said preventing means including a selector mechanism including a wall that is movable between first and second positions, said selector wall in said first position therefor preventing movement of the advancing roller in said first position therefor away from the frame opening axis, said selector wall in said second position therefor preventing movement of the advancing roller in said second position therefor away from the frame opening axis, there being cooperating means on the selector mechanism and frame for allowing the wall to be moved between the first and second positions therefor without disassembling any part from the advancing mechanism and for releasably holding the wall consistently in each of its first and second positions, wherein said preventing means includes a first shoulder on one of the frame and preventing means facing in a first direction and second and third shoulders on the other of the frame and preventing means facing oppositely to said first direction, said first shoulder being abuttable selectively to said second and third shoulders to place the selector wall respectively in said first and second positions therefor.

7. The advancing mechanism according to claim 6 wherein said first shoulder is on the selector mechanism and said second and third shoulders are on the frame, said selector mechanism including a dial that is movable between first and second positions corresponding to the first and second wall positions, said dial defining both said wall and said first shoulder.

8. The advancing mechanism according to claim 7 wherein said dial is a one-piece element.

9. The advancing mechanism according to claim 7 wherein said wall has a planar surface to abut the advancing roller mounting block in its first and second positions to thereby prevent movement of the advancing roller away from the opening axis in each of its first and second positions and the advancing roller mounting block is movable between its first and second positions in a line that is substantially perpendicular to the first line.

10. The advancing mechanism according to claim 6 wherein said dial is rotatable between its first and second positions and said first shoulder includes portions at diametrically opposite positions relative to the dial axis.

11. The advancing mechanism according to claim 10 wherein said second and third shoulders each include portions at diametrically opposite positions relative to the dial axis.

12. In a mechanism for advancing a rotating cylindrical member of the type having a frame with an opening therethrough to accept a cylindrical member advanceable therethrough in a first line, said opening having an axis, an advancing roller for engagement with a rotating cylindrical member extending through said frame opening to thereby cause advancement of a rotating cylindrical member in said first line, an advancing roller mounting block carrying the advancing roller, and cooperating means on the advancing roller mounting block and frame for allowing the mounting block to be moved between first and second positions corresponding to first and second advancing roller positions, said advancing roller in its first position being closer to the frame opening axis than in the second position for the advancing roller to thereby accommodate different diameters of a rotating cylindrical member extending through said frame opening, the improvement comprising:

means on the frame for selectively preventing movement of the advancing roller away from the frame opening axis with the advancing roller in each of its first and second positions, said preventing means including a dial that is movable between first and second positions;

said preventing means further includes means cooperating between the dial and advancing roller for a) blocking radial movement of the advancing roller relative to the frame opening outwardly from its first position with the dial in its first position and b) blocking radial movement of the advancing roller relative to the frame opening outwardly from its second position with the dial in its second position; and means for connecting the dial to the frame in an operative position and for releasably holding the dial consistently in each of its first and second positions, said connecting means including selectively abuttable shoulders on each of the frame and dial to positively block the dial selectively in each of its first and second positions, said dial being movable between its first and second position by combined rotational and axial movement thereof about an axis that is transverse to the frame opening axis without disassembly of any part of the advancing mechanism.

13. The improved mechanism for advancing a rotating cylindrical member according to claim 12 wherein the dial has a wall to engage the advancing roller mounting block to thereby prevent movement of the advancing roller away from the opening axis with the advancing roller in each of its first and second positions.

14. In a mechanism for advancing a rotating cylindrical member of the type having a frame with an opening therethrough to accept a cylindrical member advanceable therethrough in a first line, said opening having an axis, an advancing roller for engagement with a rotating cylindrical member extending through said frame opening to thereby cause advancement of a rotating cylindrical member in said first line, an advancing roller mounting block carrying the advancing roller, and cooperating means on the advancing roller mounting block and frame for allowing the mounting block to be moved between first and second positions corresponding to first and second advancing roller positions, said advancing roller in its first position being closer to the frame opening axis than in the second position for the advancing roller to thereby accommodate different diameters of a rotating cylindrical member extending through said frame opening, the improvement comprising:

means on the frame for selectively preventing movement of the advancing roller away from the frame opening axis with the advancing roller in each of its first and second positions, said preventing means including a dial that is movable between first and second positions;

said preventing means further including means cooperating between the dial and advancing roller for a) blocking radial movement of the advancing roller relative to the frame opening outwardly from its first position with the dial in its first position and b) blocking radial movement of the advancing roller relative to the frame opening outwardly from its second position with the dial in its second position; and means for connecting the dial to the frame in an operative position and for releasably holding the dial consistently in each of its first and second positions, said dial being movable between its first and second position without disassembly of any part of the advancing mechanism, wherein the dial is rotatable between its first and second positions and the dial connecting means includes means for releasing the dial from one of its first and second positions to the other of its first and second positions only by effecting movement of the dial axially of the dial relative to the frame before effecting rotation thereof.

15. In a mechanism for advancing a rotating cylindrical member of the type having a frame with an opening therethrough to accept a cylindrical member advanceable therethrough in a first line, said opening having an axis, an advancing roller for engagement with a rotating cylindrical member extending through said frame opening to thereby cause advancement of a rotating cylindrical member in said first line, an advancing roller mounting block carrying the advancing roller, and cooperating means on the advancing roller mounting block and frame for allowing the mounting block to be moved between first and second positions corresponding to first and second advancing roller positions, said advancing roller in its first position being closer to the frame opening axis than in the second position for the advancing roller to thereby accommodate different diameters of a rotating cylindrical member extending through said frame opening, the improvement comprising:

means on the frame for selectively preventing movement of the advancing roller away from the frame opening axis with the advancing roller in each of its first and second positions, said preventing means including a dial that is movable between first and second positions;

said preventing means further including means cooperating between the dial and advancing roller for a) blocking radial movement of the advancing roller relative to the frame opening outwardly from its first position with the dial in its first position and b)

blocking radial movement of the advancing roller relative to the frame opening outwardly from its second position with the dial in its second position; and means for connecting the dial to the frame in an operative position and for releasably holding the dial consistently in each of its first and second positions, said dial being movable between its first and second position without disassembly of any part of the advancing mechanism, wherein said frame includes a body, said connecting means comprises a cap on said frame that is removably connected to the frame body and the dial connecting means includes cooperating means on the frame body, frame cap and dial for captively maintaining the dial in its operative position.

16. The improved mechanism for advancing a rotating cylindrical member according to claim 15 wherein said cap is removably connected to the frame body by a plurality of bolts.

17. The improved mechanism for advancing a rotating cylindrical member according to claim 15 wherein there is a first shoulder on one of the dial and the cap facing in a first direction and second and third shoulders on the other of the dial and the cap facing oppositely to said first direction, said first shoulder being abuttable to said second and third shoulders to place the dial selectively in its first and second position.

18. The improved mechanism for advancing a rotating cylindrical member according to claim 15 wherein the dial is rotatable between its first and second positions about an axis, the first shoulder is on the dial and has portions at diametrically opposite sides of the dial axis and the second and third shoulders each have portions at diametrically opposite sides of the dial axis.

19. The improved mechanism for advancing a rotating cylindrical member according to claim 18 wherein the dial has a tab extending to externally of the frame cap to be engaged by a user to facilitate repositioning of the dial.

20. The improved mechanism for advancing a rotating cylindrical member according to claim 18 wherein said dial has a one-piece construction defining said first shoulder and said tab.

* * * * *